US006130500A

United States Patent [19]

Park et al.

[11] Patent Number: 6,130,500

[45] Date of Patent: Oct. 10, 2000

[54] DOMING EFFECT RESISTANT SHADOW MASK FOR CATHODE RAY TUBE AND ITS FABRICATING METHOD

[75] Inventors: No Jin Park; Myung Hoon Oh; Sang Mun Kim, all of Kyungsangbuk-do, Rep. of Korea

[73] Assignee: LG Electronics Inc., Seoul, Rep. of Korea

[21] Appl. No.: 09/037,519

[22] Filed: Mar. 10, 1998

[30] Foreign Application Priority Data

Dec. 3, 1997 [KR] Rep. of Korea ..... 97-65620

[51] Int. Cl.[7] ..... H01J 29/80; H01J 9/12

[52] U.S. Cl. ..... 313/402; 313/407; 445/47

[58] Field of Search ..... 313/402, 364, 313/403, 407; 445/47; 148/336

[56] References Cited

U.S. PATENT DOCUMENTS

| | | | |
|---|---|---|---|
| 4,528,246 | 7/1985 | Higashinakagawa et al. | 313/402 |
| 5,236,522 | 8/1993 | Fukuda et al. | 148/336 |

FOREIGN PATENT DOCUMENTS

| | | |
|---|---|---|
| 62-288191 | 12/1987 | Japan . |
| 63252991 | 10/1988 | Japan . |
| 3285893 | 12/1991 | Japan . |
| 3295893 | 12/1991 | Japan . |
| 4321583 | 11/1992 | Japan . |
| 5270968 | 10/1993 | Japan . |
| 5270974 | 10/1993 | Japan . |
| 5270975 | 10/1993 | Japan . |
| 5270976 | 10/1993 | Japan . |
| 7172981 | 7/1995 | Japan . |
| 9-2893 | 1/1997 | Japan . |

*Primary Examiner*—Nimeshkumar D. Patel
*Assistant Examiner*—Joseph Williams

[57] ABSTRACT

Provided with a shadow mask which is designed to suppress the doming effect by providing a shadow mask plate material for a color CRT having an ideal texture suitable for an etching to form the uniform profile of holes for the electron beams to pass through and thereby to prevent the etching deviation, the shadow mask plate material consisting of as main component Fe—Ni alloy, thus the shadow mask being characterized by the volume ratio of crystals with CUBE orientation being 2 to 20 times as high as that of crystals with (β)-Fiber in the shadow mask plate material for the enhancement of etching property; and the method of manufacturing the shadow mask including the steps of hot-rolling and cold-rolling, thermal-refining and heat-treating the shadow mask raw material to obtain a shadow mask thin plate having the volume ratio of crystals with CUBE orientation being 2 to 20 times as high as that of crystals with (β)-Fiber; and etching, forming and blackening the resulting shadow mask thin plate.

10 Claims, 2 Drawing Sheets

Position of Orientation

■ Cube:{100}<001>, {0° ,0° ,0° }
● Cu :{112}<111>, {90° ,35° ,45° }
▲ S :{123}<634>, {59° ,37° ,63° }
★ Bs :{011}<211>, {35° ,45° ,0° }

β−FIBER : connecting line of Bs−S−Cu
γ−FIBER : Normal direction // <111>

Position of Orientation

■ Cube:{100}<001>, {0° ,0° ,0° }
● Cu :{112}<111>, {90° ,35° ,45° }
▲ S :{123}<634>, {59° ,37° ,63° }
★ Bs :{011}<211>, {35° ,45° ,0° }

$\beta$−FIBER : connecting line of Bs−S−Cu
$\gamma$−FIBER : Normal direction // <111>

DOMING EFFECT RESISTANT SHADOW MASK FOR CATHODE RAY TUBE AND ITS FABRICATING METHOD

BACKGROUND OF THE INVENTION

1. Field of the Invention

The present invention relates to a shadow mask for a color CRT (Cathode Ray Tube) and its fabricating method and, specially, to such a shadow mask and its fabricating method which is designed to have an ideal texture suitable for etching a shadow mask thin plate.

2. Discussion of Related Art

Color CRTs have been developed and are now being in need for the reproducibility of definite colors and in compliance with the developed transmission modes wherein the number of scanning lines is increased.

As shown in FIG. 1, a color CRT has panel 1 which is coated with fluorescent film 3 on the inner surface and coupled to funnel 2 with fused adhesive glass, the inner surface of the funnel 2 being coated with conductive graphite. Electron guns 6 to generate electron beams 5 are mounted in the neck 4 of the funnel 2, and shadow mask 7 functioning as color-discreted electrodes is supported by frame 8 in the panel 1. The circumferential surface of the funnel 2 has deflection yoke 9 mounted to deflect the electron beams 5 in the transverse direction.

The color CRT further includes an inner shield fastened to the frame 8 in order to prevent the deviation of electron beams 5 from their given paths due to the earth magnetic field or the leaked magnetic field.

Under the picture signals applied to electron guns 6 in the color CRT as constructed above, thermoelectrons released from the cathodes of the electron guns are accelerated and converged upon the panel 1 by means of the voltage applied to each electrodes of the electron guns 6.

At this stage, the electron beams 5 are adjusted in direction by the magnetic field of the deflection yoke 9 built in the neck 4 of the funnel 2, the beams 5 being affected by the inner shield so as not to deviate from the given paths and projected onto the whole surface of the panel 1. Passing through the slots of the shadow mask 7 associated with the frame 8 in the panel 1, the deflected electron beams 5 are divided by colors and strike the fluorescent film 3 coated on the inner surface of the panel 1, emitting lights to represent picture signals.

In the structure, the shadow mask 7 is made of rimmed steel (series by JISG 3141) or AK (Aluminum Killed) steel.

As the color CRTs have been developed to be high definition, however, these materials have a high heat expansion coefficient of about $11.5\times10^{-6}$ $deg^{-1}$ that the electrons given off by the electron beams strike the shadow mask, producing heat sufficient to expand the shadow mask. This causes a phenomenon, so-called doming effect, where the electron beams cannot reach designated spots on the fluoresent film but strike unwanted colors. Doming effect has become an important problem with televisions, displays and the like which have been developed to be of high definition and high luminance.

A previous method involves the use of material having a low heat expansion property of the shadow mask for the purpose of prevention of the doming effect. For example, the shadow mask may be made of Fe—Ni invar-based alloy (Ni: 36%, Fe: 64%) having the low heat expansion coefficient of $1.5\times10^{-6}$ $deg^{-1}$, which method is described in JP-A 61-78033 and JP-A 04-56107.

To prepare a shadow mask, a thin invar disc plate is perforated with several hundred and thousands or millions of holes for the electron beams to pass through, in an etching step and undergoes a heat treatment and a molding step to have the curved profile.

The shadow mask is manufactured from a thin plate made of invar alloy and having the thickness between 0.1 and 0.2 mm, which is removed fat, washed, coated with a photoresist, exposed, developed, etched, removed the photoresist, cut, etching again and annealed, followed by a press forming, blackening, welding and packing.

While the heat expansion coefficient of the shadow mask made of AK steel is $11.5\times10^{-6}$ $deg^{-1}$, the invar shadow mask has a low heat expansion coefficient ($1.5\times10^{-6}$ $deg^{-1}$) so as to form of hole for the electron beams to pass through at adequate positions in the shadow mask irrespective of temperature. Invar-based material is expected to be used in manufacturing the shadow mask suitable for the display of a computer that requires high definition still picture for high definition and high quality television broadcast, but required to be improved in etching and forming properties.

For high quality shadow mask, it is necessary to perforate the shadow mask with hole having small pitch and uniform profile by the etching step.

Furthermore, the plate made of Fe—Ni alloy is hard to have an etching in making the hole of uniform profile compared with the AK steel plate.

For example, this problem of etching with the Fe—Ni alloy shadow mask can be improved by controlling the carbon content below 0.01% (JP-A 61-82453) or by limiting the non-metallic inclusion (JP-A 61-84356).

JP-A 59-32859, JP-A 61-19737, KR88-102, U.S. Pat. No. 4,528,246 and KR97-147 disclose the use of invar shadow mask which is manufactured to have the {100} texture of 35% or more by controlling the cooling and annealing steps in the manufacture of the invar shadow mask material.

In the cited references, it is described that such an invar shadow mask material is easily perforated with the hole of uniform size by an etching step thereby improving the doming property with high reproducibility of definite colors.

However, the material having the carbon content even below 0.01% contains contaminating substances such as S, B and N which are segregated in the grains or enter the crystals as interstitial atoms and affect the etching property of the material.

If the {100} texture is developed, the etching is improved because a {100} crystal plane has the highest etching rate. However, when the {100} texture has a high degree of integration, particularly above 95%, the etching is performed so fast along the crystal lattice as to form non-uniform hole without a roundness. Therefore, it cannot be said that the optimum crystal orientations for an adequate etching are obtained by the {100} texture of more than 35% as suggested in JP-A 61-19737.

SUMMARY OF THE INVENTION

Accordingly, the present invention is directed to a shadow mask for a CRT and its fabricating method that substantially obviates one or more of the problems due to limitations and disadvantages of the related art.

An object of the present invention is to solve the problems of the invar-based alloy thin plate and thus provide a shadow mask which is designed to have the uniform profile of holes for the electron beams to pass through with a good out-of-roundness and to prevent the doming effect by minimizing the etching deviations.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the volume ratio of crystals with CUBE orientation is 2 to 20 times as high as that of crystals with cold-rolled texture, i.e., β-fiber in the crystalline texture of a shadow mask by reducing the β-fiber and increasing the cube orientation in order to obtain the shadow mask of good etching property.

The present invention includes a shadow mask for a CRT which is made of a shadow mask plate material consisting of as main component Fe—Ni alloy and characterized by the volume ratio of crystals with CUBE orientation being 2 to 20 times as high as that of crystals with β-fiber in the shadow mask plate material for the enhancement of etching property.

The present invention further includes a method of manufacturing a shadow mask for a CRT which consists of as main component Fe—Ni alloy. The method comprises the steps of:

- hot-rolling and cold-rolling a shadow mask raw material having a FCC (Face-Centered Cubic) lattice structure, after cutting;
- heat-treating the shadow mask raw material in the temperature between 800 and 1200° C. to obtain the cube orientation;
- thermal-refining and annealing shadow mask raw material to obtain a shadow mask thin plate in the disc form having the volume ratio of crystals with CUBE orientation being 2 to 20 times as high as that of crystals with β-fiber.

The resulting shadow mask disc plate is etched, molded and blackened.

The annealing after the thermal-refining step is performed in the 600 to 700° C. range of temperature.

The annealed shadow mask disc place is etched and heat-treated at 800 to 1000° C.

The heat treatments (respectively, after cold-rolling, roughening and etching steps) are carried out in the hydrogen atmosphere.

The cold-rolling rate per a pass is in the range between 30 and 50% and cold-rolling is performed at least two times.

The principle of the present invention is described as follows.

Most metals are composed of fine polycrystals, which are hardly in the random orientation distribution. The crystals in metals form a preferred orientation or texture through plastic deformation by hot or cold processing, or heat treatment.

Depending on the systematic arrangement of the crystals, the mechanical, magnetic and chemical properties are changed and the etching property of the metal becomes better with more texture of {100} crystals. However, three-dimensional analysis for the crystal orientations in the material is needed for more exact determination.

With respect to the orientation distribution of crystals to understand the texture, it is necessary to define the relationship between the orientations of crystals in each sample and the sample coordinate system, as shown in FIG. 2.

Suppose that g is the rotational orientation required to transform the sample coordinate system $K_a$ into the crystal coordinate system $K_B$, the texture is expressed by a function f(g) which represents the volume ratio of crystals having a specified orientation g and is a multiple of the function for a random orientation distribution without texture.

Orientation g is referred to as Euler angle $\{\Phi, \Psi, \Phi_2\}$ or Miller index (hkl) [uvw], as shown in FIG. 3.

The coordinate is set such that (hkl) in the Miller index designates the plane parallel with the rolling direction of the plate material and [uvw] represents the rolling direction.

$$f(g) = \frac{dV(g)/V}{dg}, \quad g = \{\Phi_1, \Psi, \Phi_2\}, \ (hkl)[uvw]$$

$$V = \text{volume of measured range}$$

As shown in FIG. 3, the texture of an invar shadow mask material having a face-centered cubic lattice structure can be expressed by β-Fiber associated with three orientations for Cu, S and Bs, and one cube orientation.

The β-Fiber component exists in a texture that usually appears when an invar alloy having the face-centered cubic lattice structure is subjected by a cold rolling step. The CUBE orientation is for the texture of the recrystallized face-centered cubic material. The orientation means the following.

Cu orientation is {112 }<111> for the Miller index where the position $\{\Phi_1, \Psi, \Phi_2\}$ of g is {90°, 35°, 45°}, S orientation is {123 }<634> for the Miller index where the position $\{\Phi_1, \Psi, \Phi_2\}$ of g is {59°, 37°, 63°}, Bs orientation is {011 }<211> for the Miller index where the position $\{\Phi_1, \Psi, \Phi_2\}$ of g is {35°, 45°, 0°}, and CUBE orientation is {100}<001> for the Miller index where the position $\{\Phi_1, \Psi, \Phi_2\}$ of g is {0°, 0°, 0°}.

The distribution of these orientations can be estimated with measured POLE FIGURE by the X-ray diffraction method.

In an invar shadow mask with the face-centered cubic lattice structure, four pole figures 111, 200, 220 and 311 are measured by using a goniometer in all possible rotational directions to determine the diffraction intensity of crystals in the X-ray diffraction method.

The diffraction intensity is proportional to the volume of crystals whose special plane in the sample (hkl) accords with the diffraction plane.

After the measurement of four pole figures 111, 200, 220 and 311, the orientation distribution function (ODF) is perfectly calculated by using the harmonic method and positivity to obtain the volume ratios f(g) of Bs, Cu and CUBE orientations as follows:

$$f(g)_{CUBE} = \frac{dV(g)/V}{dg}, \quad g = \{0°, 0°, 0°\}, \text{ or}$$

$$, \quad g = (100)\langle 001\rangle$$

$$f(g)_{cu} = \frac{dV(g)/V}{dg}, \quad g = \{90°, 35°, 45°\}, \text{ or}$$

$$, \quad g = (112)\langle 111\rangle$$

$$f(g)_s = \frac{dV(g)/V}{dg}, \quad g = \{59°, 37°, 63°\}, \text{ or}$$

$$, \quad g = (123)\langle 634\rangle$$

$$f(g)_{Bs} = \frac{dV(g)/V}{dg}, \quad g = \{35°, 45°, 0°\}, \text{ or}$$

$$, \quad g = (011)\langle 211\rangle$$

The ratio of the volume ratio of the CUBE texture, $f(g)_{CUBE}$ to the volume ratio of the rolling texture, f(g)

$\beta$-*FIBER* is referred to as RD (Recrystallization Deformation) value and given by:

$$RD = \frac{f(g)_{CUBE}}{\text{Mean value of } f(g)_{\beta\text{-}fiber}}$$

that is, $$RD = \frac{f(g)_{CUBE}}{\frac{1}{3}[f(g)_{Cu} + f(g)_s + f(g)_{Bs}]}$$

When the material is perfectly recrystallized to develop the CUBE texture, $f(g)_{CUBE}$ becomes high in relation with reduced $f(g)_{\beta\text{-}FIBER}$ of the $\beta$-fiber component of the rolling texture, allowing the increase of the RD value which is the ratio of the volume ratio of the CUBE texture, $f(g)_{CUBE}$ to that of the rolling texture, $f(g)_{\beta\text{-}FIBER}$.

Such an increase in the RD value means that more {100} crystal planes are integrated on the surface of the shadow mask plate.

RD is the value of 1 if the crystals are perfectly random in distribution, or else less than 1 if the crystals are less recrystallized.

When the value of RD is less than 2, the cold-rolled texture developed makes it hard to secure the uniform-etching property with a consequence of non-uniform profile of holes in the shadow mask. When RD is above 20, the portion of texture {100}<001> is developed to cause a problem of etching into non-uniform profile of the holes.

The RD value is thus preferably in the range of between 2 and 20 in the present invention fog the purpose of uniform-etching property.

The shadow mask made of invar alloy is manufactured as below in the present invention.

Steel melt in an electric or electronic furnace is first rolled or continuously molded into a slab and subjected by a hot-rolling step, producing a steel plate in the 2 to 5 mm range of thickness. The steel plate is annealed, cleaned with acid and cold-rolled into a thin plate between 0.1 and 0.2 mm thick.

The cold processing is to prevent the setting of the material and secure the smoothness of the product and carried out at least two times with the rolling rate of 30 to 50% per one time. After the acid cleaning step, the material is annealed at above 800° C. under the hydrogen atmosphere.

The rolling rate is then regulated less than 10% in order to control thickness and smoothness. Following a thermal refining, the thin plate is annealed at a temperature between 600 and 700° C. in the hydrogen atmosphere, washed, dried, coated with a photoresist, developed and etched with a ferric chloride solution.

The resulting product is washed and dried to obtain a perforated shadow mask.

This shadow mask undergoes a heat treatment in the 800 to 1000° C. range of temperature to soften to yield a strength for good forming and a warm rolling at 200° C. to prevent any deformation during the later molding step. A shadow mask is completed after molding and blackening steps.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Figure 1:
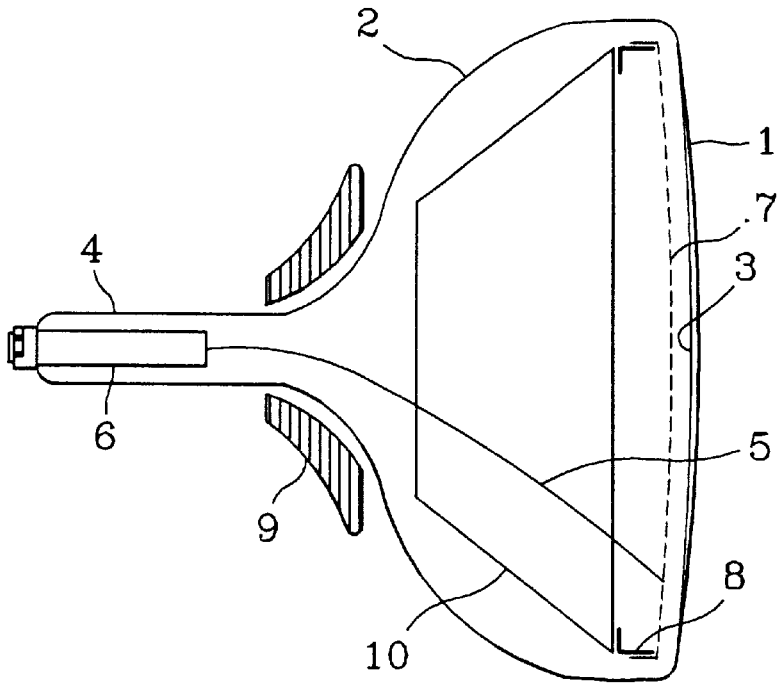
Fig.1 Background Art
FIG. 1 is a cross-sectional view of the structure of a CRT.
Figure 2:
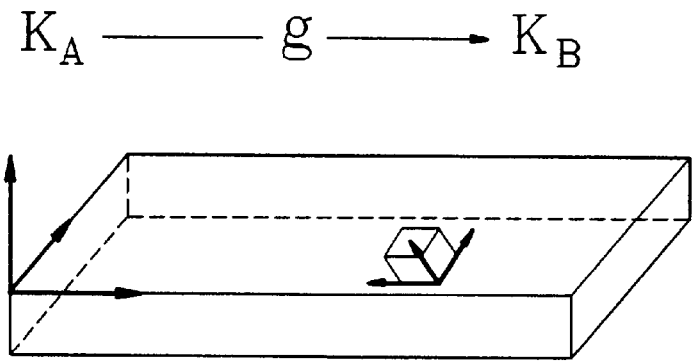
FIG. 2 shows the rotational orientations required to transform the sample coordinate system into the crystal coordinate system.
Figure 3:
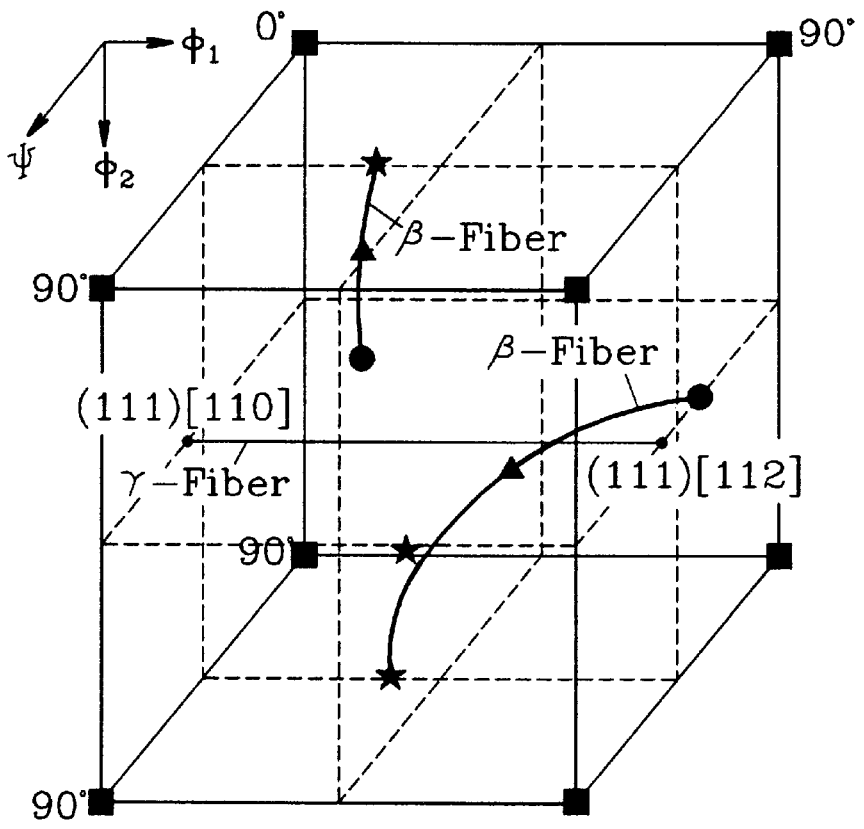
FIG. 3 shows the state of the calculated EULER space having the FIBER and orientations in a metal with the face-centered cubic lattice structure.

Reference will now be made in detail to the preferred embodiments of the present invention, examples of which are illustrated in the accompanying drawings.

An ingot is prepared by blending the raw materials in the composition of Fe 63 wt. %, Ni 36 wt. %, Mn 0.2 wt. %, Cr 0.1 wt. %, C 0.01 wt. %, Mo 0.3 wt. %, Si 0.05 wt. %, B 0.001 wt. %, Cu 0.02 wt. % and Co 0.4 wt. %, with the subsequent of vacuum dissolution.

This ingot is then subjected to a continuous hot processing step into stripes of 10 mm in diameter, which are cut in the lengthwise direction to produce a plate 0.2 mm thick and 1000 mm in width.

The plate undergoes a hot rolling step at 1100° C. and a cold rolling step at 1000° C. successively for multiple times, thus making an invar shadow mask plate. The plate is subjected to a heat treatment at 1000° C. for 2 hours or more under the hydrogen atmosphere, a thermal refining step with the rolling rate of 10% for multiple times, and an annealing step at 650° C., allowing the production of a shadow mask plate of 0.1 mm.

The shadow mask plate is perforated with holes for the electron beams to pass through, by an etching step with a 38% ferric chloride solution.

The shadow mask plate is estimated for the RD value in order to measure the etching property varied depending on the RD value, as listed in Table 1.

The estimation of the present embodiment is performed in the following procedure.

In an invar shadow mask, four pole figures 111, 200, 220 and 311 are measured by using a goniometer in all possible rotational directions to determine the diffraction strength of crystals in the X-ray diffraction method.

After the measurement of four pole figures 111, 200, 220 and 311, the orientation distribution function (ODF) is perfectly calculated by using the harmonic method and positivity to obtain the volume ratios f(g) of Bs, Cu and cube orientations. The RD value is then calculated from theses functions by the equation given by:

$$RD = \frac{f(g)_{CUBE}}{\frac{1}{3}[f(g)_{Cu} + f(g)_s + f(g)_{Bs}]}$$

The etching factor, the ratio of etching depth to side etching amount is measured with a microscope when the shadow mask plate of the present invention is 100 $\mu$m in diameter. At this stage, the etching conditions are the concentration of solution of 42 Baume, the temperature of 50° C., and the pressure of 2.5 Kgf/cm$^2$. Around 3 is the allowable etching factor.

The profile of the mask hole for the electron beams to pass through is classified into three grades a, b and c by measurement and estimation through a picture processing with an editing computer, wherein a is the highest grade.

The out-of-roundness is the ratio the minimum distance between the two straight lines in parallel drawn on the hole to the maximum distance between them.

TABLE 1

| NO. | RD | ETCHING FACTOR | PROFILE OF Hole | OUT-OF-ROUNDNESS |
|---|---|---|---|---|
| 1 | 0.8 | 1.9 | c | 0.97 |
| 2 | 3.5 | 2.0 | b | 0.99 |
| 3 | 5.8 | 2.1 | a | 1.0 |
| 4 | 7.5 | 2.1 | a | 1.0 |
| 5 | 8.2 | 2.2 | a | 1.0 |
| 6 | 12.1 | 2.6 | a | 1.0 |
| 7 | 22.3 | 3.3 | c | 0.95 |
| 8 | 24.2 | 3.3 | c | 0.96 |

Table 1 shows that a shadow mask has the uniform-etching property when the RD value is between 2 and 20.

Additionally, the RD value more than 20 or less than 2 leads to a non-uniform etching.

According to the present invention as described above, a shadow mask which is capable of preventing the doming effect is manufactured by reducing the cold-rolled texture i.e., the β-fiber and increasing the cube orientation texture in the shadow mask to have the volume ratio of crystals with CUBE orientation be 2–20 times as high as that of crystals with β-fiber, thus producing the uniform profile of holes with the excellent out-of-roundness and less etching deviation in an etching step.

It will be apparent to those skilled in the art that various modifications and variations can be made in the shadow mask for a CRT and its fabricating method of the present invention without departing from the spirit or scope of the invention. Thus, it is intended that the present invention cover the modifications and variations of this invention provided they come within the scope of the appended claims and their equivalents.

What is claimed is:

1. A shadow mask for a cathode ray tube, which shadow mask is made of a shadow mask plate material consisting of as main composition Fe—Ni alloy, the shadow mask being characterized by the volume ratio of crystals with CUBE orientation being 2 to 20 times as high as that of crystals with β-Fiber in the shadow mask plate material for the enhancement of etching property.

2. A method of manufacturing a shadow mask for a cathode ray tube, which shadow mask consists of as main component Fe—Ni alloy, the method comprising the steps of:

hot-rolling and cold-rolling a shadow mask material having a face-centered cubic lattice structure;

heat-treating the shadow mask material in the temperature between 800 and 1200° C.;

skin pass rolling and heat-treating the shadow mask material to obtain a shadow mask thin plate having the volume ratio of crystals with CUBE orientation being 2 to 20 times as high as that of crystals with β-Fiber; and etching, forming and blackening the resulting shadow mask thin plate.

3. The method as defined in claim 2, wherein the cold-rolling rate per a cycle of the cold-rolling step is in the range between 30 and 50%.

4. The method as defined in claim 2, wherein at least two times of cold-rolling is performed.

5. The method as defined in claim 2, wherein during the skin pass rolling and heat-treating step, the temperature is in the range of between 600 and 700° C. in performing the heat treatment.

6. The method as defined in claim 2, wherein after the etching, the temperature is in the range of between 800 and 1000° C. in the heat treatment to perform the forming step.

7. The method as defined in claim 2, wherein the heat treatment is performed in the hydrogen atmosphere.

8. The method as defined in claim 2, wherein the forming is a hot molding.

9. The method as defined in claim 5, wherein the heat treatment is performed in the hydrogen atmosphere.

10. The method as defined in claim 6, wherein the heat treatment is performed in the hydrogen atmosphere.

* * * * *